United States Patent [19]

Mathes

[11] 4,128,905

[45] Dec. 12, 1978

[54] BASIN RECEPTACLE

[76] Inventor: Larry W. Mathes, R.R. 5, Box 11, Corydon, Ind. 47112

[21] Appl. No.: 810,915

[22] Filed: Jun. 29, 1977

[51] Int. Cl.[2] ..... A47C 19/00

[52] U.S. Cl. ..... 4/187 R; 4/188; 4/189; 4/287; 4/288

[58] Field of Search ..... 4/187 R, 189, 188, 190, 4/258, 263, 270, 274, 285, 286, 288, 289, 290, 292, 166, 167, 76

[56] References Cited

U.S. PATENT DOCUMENTS

| | | | |
|---|---|---|---|
| 919,602 | 4/1909 | Lee | 4/166 |
| 1,456,841 | 5/1923 | Brown | 4/166 |
| 2,019,642 | 11/1935 | Alley | 4/166 |
| 2,671,909 | 3/1954 | Santarsiero | 4/287 |
| 2,780,303 | 2/1957 | Yavitch | 4/295 X |
| 3,333,283 | 8/1967 | Patterson | 4/189 |
| 3,377,634 | 4/1968 | Patterson | 4/189 UX |
| 3,415,299 | 12/1968 | Hinman, Jr. et al. | 4/110 |
| 3,457,570 | 7/1969 | Williams | 4/190 |

*Primary Examiner*—Henry K. Artis

*Attorney, Agent, or Firm*—Woodard, Weikart, Emhardt & Naughton

[57] ABSTRACT

A receptacle for temporary retention of fluid as well as for routing fluid from a basin faucet to a basin drain. One disclosed embodiment includes a body member, a valve, a base member, anchoring means and a spacing plate. The body member is positionable beneath the faucet and has an open bowl portion into which water from the faucet can flow. Joined to the base of the bowl portion is a hollow neck portion in which a valve is positioned. The valve is manually operable to open or close a passageway through the neck and thus the valve controls the retention and release of water from within the bowl portion. The anchoring means includes a stem-like member on which compressible, triangularly-shaped bosses are formed. The bosses effect an interference fit with the inner walls of the drain to secure the receptacle in an upright position. The base which is joined to the neck portion includes a flange which rests atop the spacing plate. The spacing plate which has a series of radially extending grooves on its bottom surface, is contiguous to the basin and surrounds the drain opening when the anchoring means are fully inserted into the drain. Water within the basin is allowed to drain by passing through the radially extending grooves while the bowl portion retains water when the valve is in a closed position. In the event the spacing plate is removed, the flange is flexible enough to seal around the drain and thereby prevents water within the basin from escaping through the drain. With the valve open, the receptacle always permits water from the faucet to pass directly to the drain and not enter the basin or mix with water which is retained within the basin.

17 Claims, 11 Drawing Figures

BASIN RECEPTACLE

BACKGROUND OF THE INVENTION

1. Field of the Invention

This invention relates in general to liquid receptacles and in particular to lavatory devices.

2. Description of the Prior Art

There is wide variation in the style of plugs and stoppers which are used to close off basin drain openings. Normally such devices come as part of the basin or sink plumbing hardware and can be manually operated to open or close by means of a toggle lever or plunger. Such devices have a very limited application and usually a singular purpose — to seal the drain opening.

Other devices are known which fit in and around sinks such as the devices disclosed by U.S. Pat. No. 3,333,283 to Patterson; U.S. Pat. No. 3,038,172 to Fritz et al.; U.S. Pat. No. 2,923,025 to Liftman; U.S. Pat. No. 2,902,700 to Chambers and U.S. Pat. No. 2,691,237 to Heim. The devices disclosed by Liftman and by Heim pertain to accessory items and are not associated with the drain or the retention of water in the sink. The devices disclosed by Fritz et al. and by Chambers pertain to waste removal apparata such as garbage disposers. Such devices are constructed to fit within and around a sink dran, but are not designed to retain water. The closest prior art reference to the concept of a liquid receptacle associated with placement in or around a sink or basin drain is the device disclosed by Patterson. Although the Patterson device fits within a drain opening and supports itself in an upright position, this device is limited to one mode of operation. This mode of operation is one in which utensils placed in the dish drain drain water out through an opening in its base into the sink drain while lateral openings in the dish drain permit water to pass from the sink space surrounding the dish drain to the sink drain. The disadvantage with such a device is that its use is limited. The device is not adjustable for different applications such as closing off the sink drain to retain water therein or such as closing the opening for the retention of water within the dish drain.

In certain situations, such as when shaving, it is desirable to have one supply of water to clean the razor while having a separate supply of water, free from whiskers, for washing the hands and face or some other use. Applicant is unaware of any further prior art devices which would permit the segregation of water in a lavatory basin while permitting flow from the basin faucet into the basin drain. Although liquid-retaining receptacles are known in the art, applicant is unaware of any such receptacles which fit within a basin drain opening and which can both seal the basin drain and retain fluid in the receptacle. Applicant is also unaware of any prior devices which employ open and close valves as part of a basin-mounted receptacle.

SUMMARY OF THE INVENTION

One embodiment of the present invention might include a receptacle for routing fluid from a faucet to a drain opening which comprises a body portion, a flange and anchoring means. The body portion has a passageway therethrough and the flange is joined to the body portion at one end of the passageway. The anchoring means is joined to the flange and is insertable into the drain opening for securing the receptacle in an upright position between the faucet and the drain opening. When the anchoring means is fully inserted into the drain opening, the flange seals around the drain opening.

Another embodiment of the present invention might include a receptacle positioned between a basin faucet and a drain opening for temporary retention of one fluid while allowing another fluid in the basin to empty into the drain which comprises a body member, valve means, a hollow base member, anchoring means and a hollow spacing plate. The body member has an open bowl portion and an adjoining, hollow neck portion opening into the bowl portion. The valve means are positioned within the neck portion and controls the flow of fluid from the bowl portion through the neck portion. The hollow base member has an upper surface which is joined to the neck portion and a lower surface which is surrounded by a flange. The anchoring means are joined to the lower surface of the base and are insertable into a drain opening thereby securing the receptacle in an upright position. A plurality of clearance channels are provided between the anchoring means and the drain opening in which the anchoring means are inserted. The hollow spacing plate has a top surface which is adjacent to the flange and a plurality of radially extending grooves in a bottom surface. The plate is slidably received by the anchoring means such that when the anchoring means are fully inserted into the drain opening, the top surface is contiguous to the flange, the bottom surface is contiguous to the basin and the grooves establish a path for fluid flow from the basin to the clearance channels.

One object of the present invention is to provide an improved, multi-use lavatory receptacle.

Related objects and advantages of the present invention will be apparent from the following description.

DESCRIPTION OF THE PREFERRED EMBODIMENT

Figure 1:
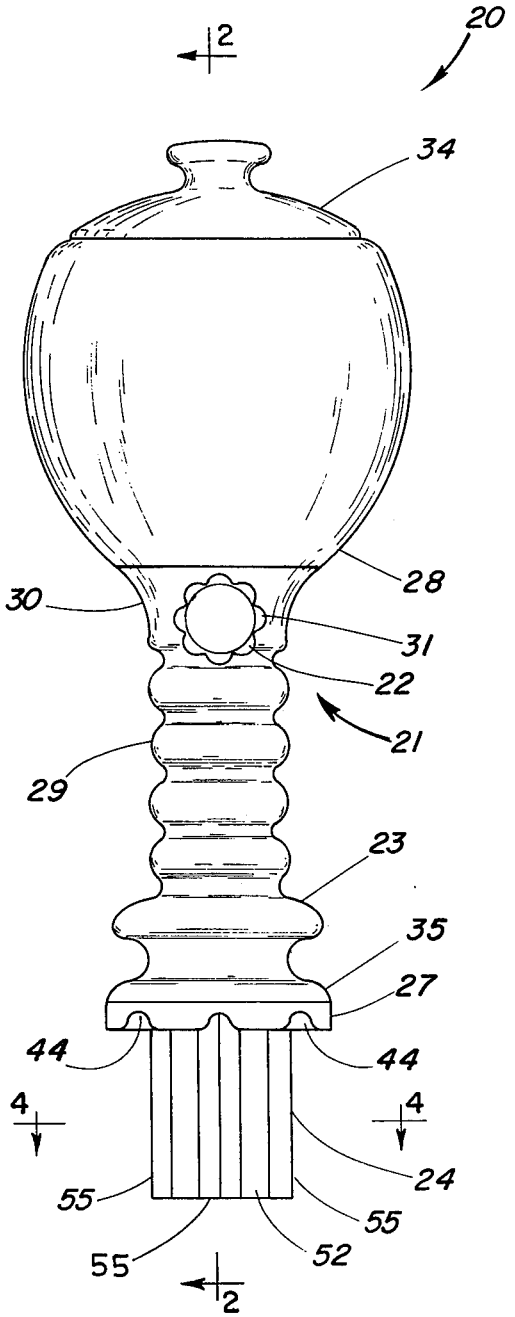
FIG. 1 is a side elevational view of a basin receptacle according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a basin receptacle 20 which comprises a body member 21, a valve 22, a base member 23, an anchoring stem 24 and a spacing plate 27. Body member 21 includes bowl portion 28 and neck portion 29 which is attached to the lower, tapered end 30 of bowl portion 28. Valve 22 extends into neck portion 29 virtually at the location where the neck portion 29 and the bowl portion 28 join to one another. Valve 22 is manually operable by means of knob 31 from an open position to a closed position whereby fluid within bowl portion 28 may be either retained (valve closed) or emptied (valve open) through neck portion 29 which is hollow. Bowl portion 28 is fitted with a lid 34 such that fluid within bowl portion 28 can be retained and not spill in the event receptacle 20 is moved or its position shifted. Anchoring stem 24 is joined to base member 23 and spacing plate 27 is slidably received over anchoring stem 24 and is located adjacent to the annular flanged portion 35 of base member 23. Anchoring stem 24 is constructed such that portions of it will be slightly compressed when stem 24 is inserted into the opening of a basin drain. This interference fit will cause the anchoring stem 24 to secure the receptacle 20 in an upright position such that spacing plate 27 is positioned against the basin and around the basin drain opening and bowl portion 28 is positioned beneath the basin faucet. Neck portion 29 is constructed of a material and in a design which allows it to be moderately flexible such that bowl portion can be positioned beneath the faucet and is adaptable to different faucet and basin configurations. In this orientation, with lid 34 removed, water which comes from the basin faucet will be allowed to fill bowl portion 28, if valve 22 is in the closed position. Once the water which has filled bowl portion 28 is desired to be drained, valve 22 is turned to an open position thereby allowing the water within bowl portion 28 to empty into the drain by passing through neck portion 29, through base member 23, and through anchoring stem 24.

Although the body member, base member, and the anchoring stem are shown and have been discussed as individual members, the preferred construction is to integrally form these various components into a single piece such as by molding. It is preferred that the components of basin receptacle 20 be fabricated from resilient material. Metal and glass would present a possibly dangerous condition due to the likelihood of breaking other glass containers common in a lavatory or of the receptacle itself being broken. While most of the components, including lid 34, may be of a fairly resilient material, it is preferred that spacing plate 27 and valve 22 be somewhat rigid. There are various plastic and rubber material compositions which would be suitable for the receptacle and its various components.

Figure 2:
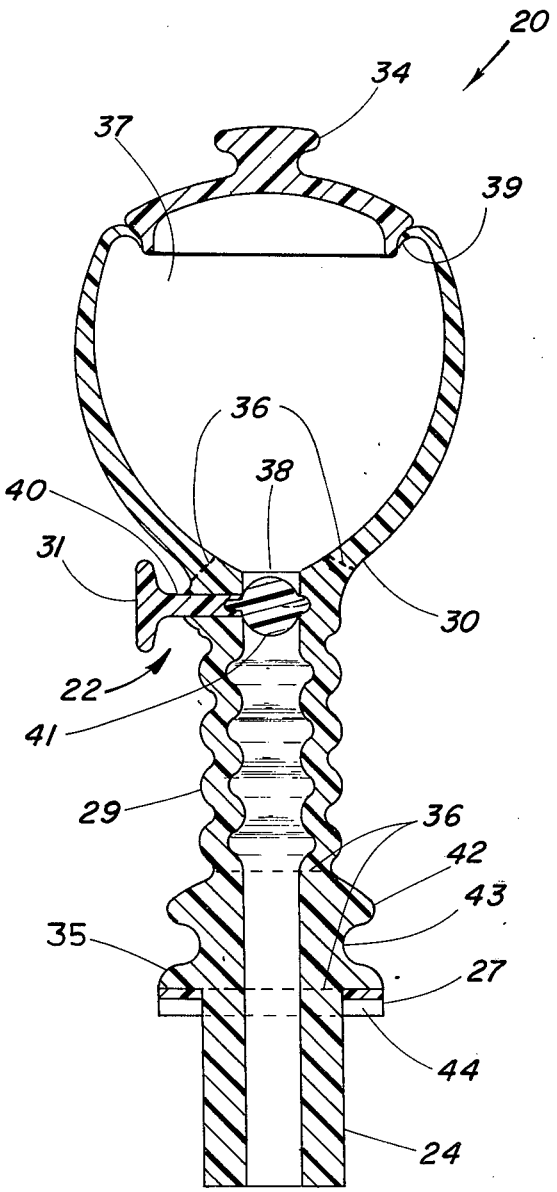
FIG. 2 is a cross-sectional view of the FIG. 1 receptacle taken along line 2—2 in FIG. 1.

FIG. 2 is a cross section of the FIG. 1 basin receptacle and is shown as the preferred single piece construction, except for the valve 22, plate 27 and lid 34. However, for drawing discussion, dotted lines 36 have been included to suggest a convenient interface between bowl portion 28 and neck portion 29 as well as between neck portion 29, base member 23, and anchoring stem 24. In the event a single molded unit is not the method of manufacture and individual pieces are fabricated instead and then joined together, these dotted lines 36 suggest one arrangement for the various receptacle portions. As shown by FIG. 2, bowl portion 28 has a large opening 37 at the top which opens up even wider beneath the lid before tapering to a smaller opening 38 at the bottom. The down-turned annular lip 39 of bowl portion 28 provides a splash guard for the liquid contents of bowl portion 28. Annular lip 39 could also be positioned more inwardly to bowl portion 28 such that lid 34 would fit to the outer periphery of lip 39 rather than the inner edge. In this regard, the design of lid 34 is based on the type of receptacle lip which is present. The extent of overhang of lip 39 into large opening 37 may also be varied depending on the turbulence of the contents within bowl portion 28. Valve 22 is comprised of knob 31, stem 40 and valve closure element 41. The knob and stem are one integral piece which fits around closure element 41. Closure element 41 is a flat circular plate and as shown, closure element 41 is in an open position.

Base member 23 which joins to one end of neck portion 29 includes an annular rib 42 and recess 43 which are used for gripping the receptacle when it is desired to insert or remove the receptacle 20 from the drain opening. At the lower end of base member 23 is flexible flange 35 which, as has been discussed, is integrally joined to anchoring stem 24. Positioned adjacent to flange 35 is a removable spacing plate 27 which includes a plurality of radially extending grooves 44. These grooves comprise a portion of the lower surface of spacing plate 27 and when the receptacle is fully inserted into a drain opening, this lower surface will come in contact with the lower, interior surface of the basin. Consequently, if there is water in the basin, this water will be allowed to flow through these radially extending grooves 44 into the basin drain opening. Although it might appear that anchoring stem 24 would completely plug up or fill the drain opening, the design of anchoring stem 24, as will be described later, permits the receptacle to be anchored while at the same time providing clearance channels between stem 24 and the drain opening such that water emptying from the basin through the grooves will be able to pass out of the drain by means of these clearance channels.

Figure 3:
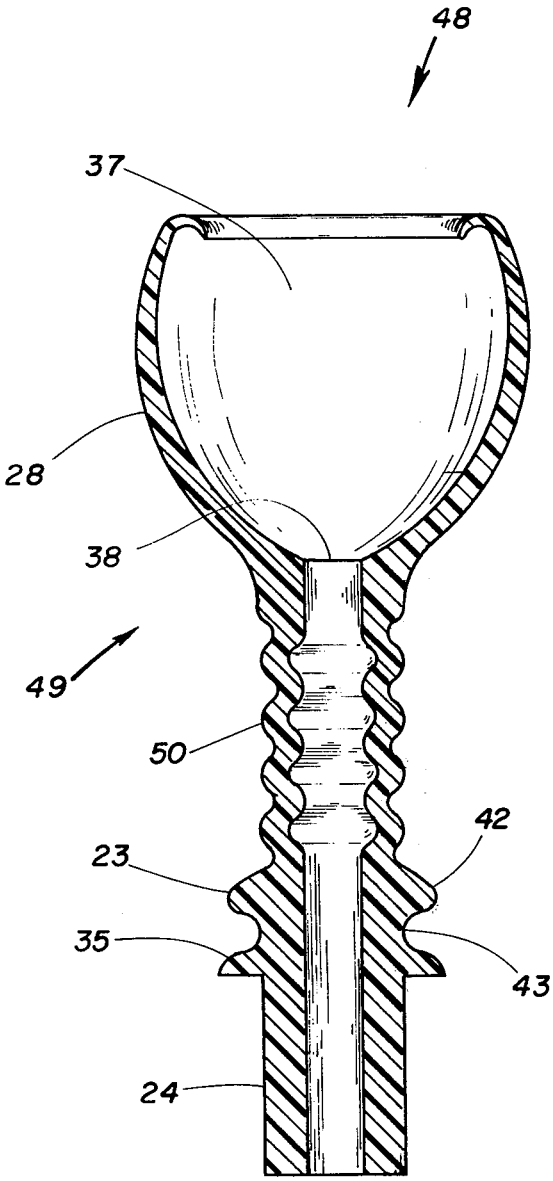
FIG. 3 is a cross-sectional view of an alternate form of a basin receptacle according to the present invention.

FIG. 3 is a sectioned view similar to FIG. 2 but shows an alternate form of basin receptacle 20. Basin receptacle 48 (FIG. 3) includes body member 49, base member 23 and anchoring stem 24. Of note is the fact that spacing plate 27 has been removed as has valve 22 and lid 34. Therefore, body member 49 still comprises bowl portion 28 but is joined to a different neck portion 50. Neck portion 50 does not have means through which a valve can be inserted and the fact that spacing plate 27 has been removed requires that flange portion 35 rests against the drain opening when the receptacle 48 is fully inserted in a drain opening.

Basin receptacle 48 is primarily designed for use when water is to be retained in the basin and at the same time running water from the faucet is required for an application such as rinsing a razor. In such an application, basin receptacle 48 would be held by means of annular rib 42 and recess 43 and anchoring stem 24 would be inserted into the drain opening. As has previously been described, the compressible nature of portions of anchoring stem 24 will allow basin receptacle 48 to be retained in the basin drain and secured in an upright position due to the interference fit between the edges of anchoring stem 24 and the inner walls of the drain. The flange portion 35 of base member 23 is flexible and of such size that it surrounds the mouth of the drain opening so that as receptacle 48 is fully inserted into the drain, flange portion 35 will contact the area surrounding the drain opening and will seal the drain opening such that water within the basin will be retained. Bowl portion 28 can then be positioned beneath the basin faucet inasmuch as neck portion 50 is flexible, so that water running from the basin faucet will be directed into bowl portion 28. If a razor is being rinsed of whiskers, the larger opening 37 will be the area in which the razor is rinsed. The soap, whisker and water residue will be directed through the smaller opening 38 and discharged through neck portion 50, through base member 23 and anchoring stem 24 and into the drain. While this is occurring, the clean water which originally filled the basin has not been emptied and remains clean and free of whiskers. This water can be used for any number of purposes, such as washing the hands and the face. A somewhat reverse use is also possible. The water retained in the basin could be used to rinse a razor, while the flow of clean water from the faucet through receptacle 48 could be used for brushing teeth (of a second user, simultaneously). The basin receptacle 48 has additional, related lavatory uses such as a spittoon for mouthwash or medicine gargle and with either of these applications, receptacle 48 would be used much the same as has been described for cleaning a razor and brushing teeth.

Figure 4:
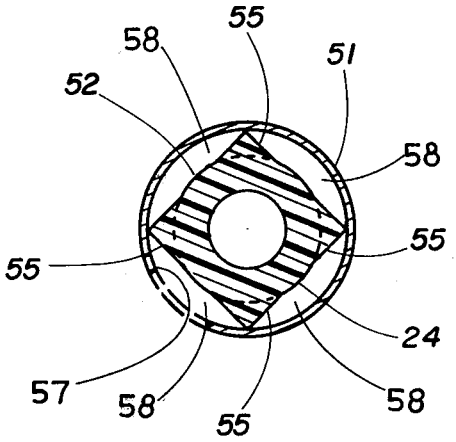
FIG. 4 is a cross-sectional view of an anchoring stem comprising a portion of the FIG. 1 receptacle taken along line 4—4 in FIG. 1.

FIG. 4 shows a cross-sectional view of anchoring stem 24 as inserted into a drain opening 51. As shown, anchoring stem 24 appears as a generally square cross section. However, the actual construction, as has been described, comprises a generally cylindrical center member 52 and four triangularly-shaped bosses which extend longitudinally along the length of center member 52 (see FIG. 1). If removed from drain opening 51, these bosses would be pointed at their ends. However, when inserted within drain opening 51, the points of these triangular bosses 55 are compressed by the interference fit within the inner wall 57 of drain opening 51. The compression of bosses 55, the interference fit within drain opening 51, accounts for the only means by which receptacles 20, 48 are secured in an upright position. Inasmuch as only the corners of the bosses 55 are in contact with the inner wall 57 of drain opening 51, clearance channels 58 are provided between inner wall 57 and anchoring stem 24. Referring to the FIG. 2 receptacle 20, fluid which passes through grooves 44 will then enter clearance channel 58 so that by use of spacing plate 27, liquid within the basin will be allowed to drain.

Figure 5:
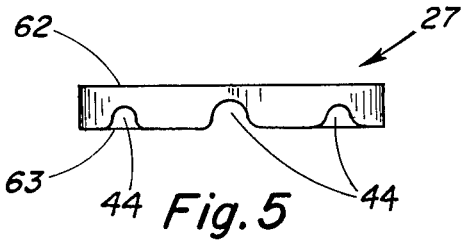
FIGS. 5 and 5*a* are a side view and a plan view, respectively, of a spacing plate comprising a portion of the FIG. 1 receptacle.
Figure 5A:
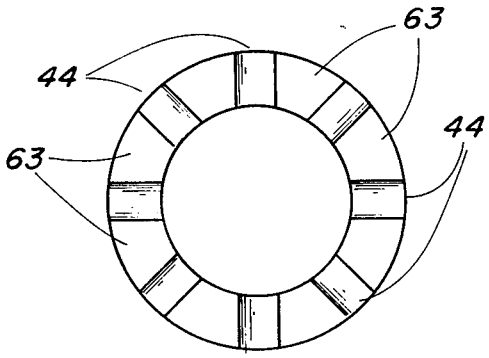

FIGS. 5 and 5*a* show a side view and a plan view, respectively, of spacing plate 27. The top surface 62 of spacing plate 27 contacts the underside of flange portion 35 on basin receptacle 20. The bottom surface 63 which includes radially extending grooves 44 is contiguous to the interior surface of the bottom of the basin when basin receptacle 20 is fully inserted into drain opening 51. Inasmuch as spacing plate 27 is slidably received on anchoring stem 24, it is conceivable that grooves 44 could be placed in direct alignment with bosses 55 such that the flow of fluid emptying from the basin through grooves 44 would be restricted, if not completely blocked, by bosses 55. Therefore, the design of spacing plate 27 is such that a plurality of, in the preferred embodiment eight, radially extending grooves 44 are included such that in the event spacing plate 27 would be so aligned with respect to anchoring stem 24 there would still be an adequate number of unobstructed grooves 44 for the passage of fluid from the basin into the clearance channels 58.

Spacing plate 27 is also reversible relative to anchoring stem 24, such that when slid onto stem 24 top surface 62 rests against the basin drain opening and radially extending grooves 44 are directly contiguous to flexible flange 35. In this arrangement, a shallow pool of liquid could be retained in the basin, below the level of grooves 44, with liquid adjacent grooves 44 draining as previously described.

Figure 6:
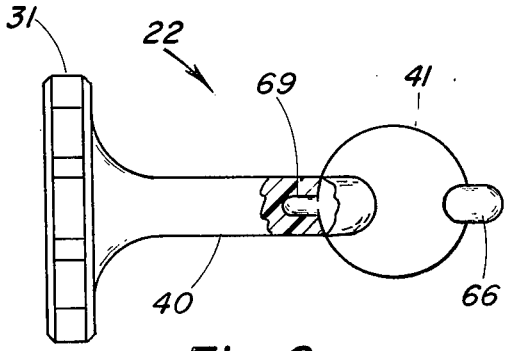
FIGS. 6 and 6*a* are a side view and a plan view, respectively, of a valve assembly comprising a portion of the FIG. 1 receptacle.
Figure 6A:
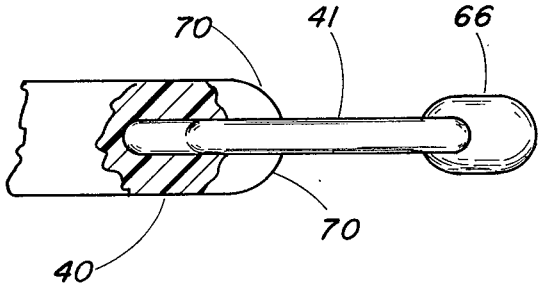

FIGS. 6 and 6*a* show a side view and a plan view, respectively, of valve 22. Valve 22 includes valve knob 31 and integral stem 40 which are secured by means of securing pin 69 to closure element 41. Attached to the opposite side of closure element 41 is a pivot pin 66 which rests within a suitably sized recess in neck portion 29 (see FIG. 2). The end of stem 40 is a clevis arrangement such that arms 70 extend on either side of closure element 41. At the base of arms 70 and positioned therebetween is a recess which accepts securing pin 69. The design of valve 22 and pivot pin 66 is such that the valve can be turned in either a clockwise or counterclockwise direction once installed within neck portion 29 and will not be limited by stops or other restricting means. This arrangement allows for valve 22 to assume different degrees of opening between a fully open or fully closed position. However, it is not likely that in activities such as gargling mouthwash or cleaning a razor that the valve would only be partially opened. Similarly, it is not likely that valve 22 would only be partially closed in those applications when a liquid was to be retained within bowl portion 28.

Figure 7:
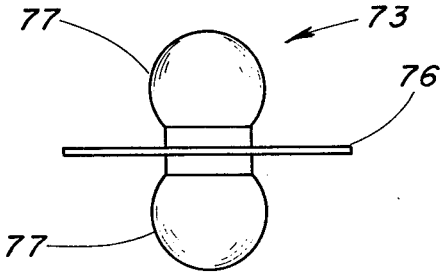
FIGS. 7 and 7*a* are a side view and a plan view, respectively, of a plug adapted for use with the FIG. 3 receptacle.
Figure 8:
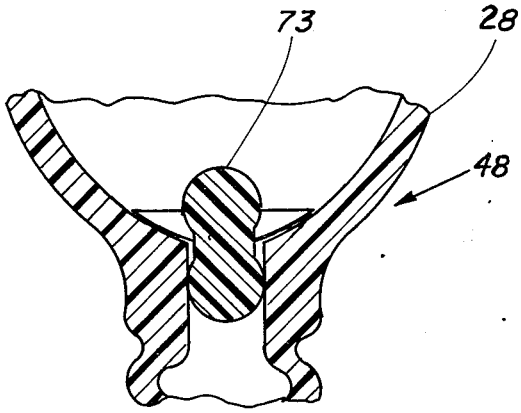
FIG. 8 is a partial side view of the FIG. 7 plug positioned within the FIG. 3 receptacle.
Figure 7A:
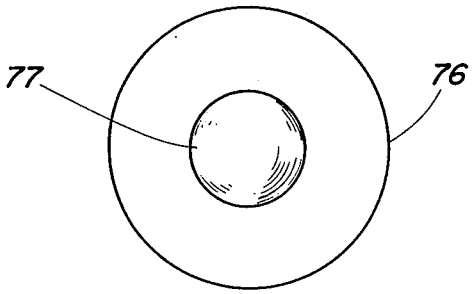

FIGS. 7 and 7*a* show a side view and a plan view, respectively, of an alternate stopper which may be used with either the FIG. 1 embodiment or the FIG. 3 embodiment although its more likely application is with receptacle 48. Receptacle 48 was described as a single unit construction without valve 22, or spacing plate 27 or lid 34. If receptacle 48 is used, there would be no way by which liquid could be retained within bowl portion 28 inasmuch as there is no valve 22. Therefore, although not as convenient as valve 22, plug 73 provides a means by which fluid can be retained within bowl portion 28 and then emptied through neck portion 50 when the use for the fluid has ended. Plug 73 comprises a retaining lip 76 positioned between two part-spherical ball portions 77. Either ball portion 77 is able to be used as a handle with the opposite ball portion being inserted into smaller opening 38 at the base of bowl portion 28 of receptacle 48. With plug 73 constructed from a fairly resilient material the inserted ball portion 77 is compressed while the wall surrounding smaller opening 38 is expanded. This force fit between the plug 73 and receptacle 48 provides an excellent seal for the contents within the bowl portion. This seal is compatible with the flexing of the receptacle as previously described. The retaining lip 76 provides a larger diameter member which serves to prevent the plug 73 from passing through the open neck portion 50 and then into an open drain. The upper ball portion 77 which extends up into bowl portion 28 is used as a gripping means to retrieve plug 73 when it is desired to empty the contents of bowl portion 28. The position of plug 73 and ball portions 77 within receptacle 48 is shown by FIG. 8.

The various uses for basin receptacle 20 both in combination with spacing plate 27 and separate from spacing plate 27 are numerous. A few applications for receptacles 20 and 48, such as cleaning a razor, brushing teeth and as a spittoon for mouthwash, have already been mentioned. However, there are other applications for basin receptacles 20 and 48 such as, for example, the following. Valve 22 could be placed in a closed position thereby closing the neck portion and dentures could be soaked within bowl portion 28. By placing lid 34 to enclose bowl portion 28, the dentures would be able to be soaked and the remaining portion of the basin would be usable for other lavatory purposes. After the soaking had been completed, valve 22 could be opened thereby opening the neck portion and draining the denture solution through the receptacle and discharging it into the drain. The flexibility of the neck portion allows the receptacle to be moved out of the way of water flowing from the faucet so that while the receptacle is used as a soaking device, water from the faucet could still enter the basin and either fill the basin or flow from the basin into the drain.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A receptacle for routing fluid from a faucet to a drain opening which comprises:

a body portion having a passageway therethrough, said body portion includes an open bowl member and integral therewith a flexible neck section;

a flange portion joined to said body portion at one end of said passageway, said flange portion including a first hollow region extending therethrough and communicating with said passageway, said neck section extending between the flange and the bowl member;

anchoring means joined to said flange and including a second hollow region extending through said anchoring means and communicating with said first hollow region, said anchoring means being insertable into said drain opening for securing said receptacle in an upright position between said faucet and said drain opening; and said flange sealingly engageable around said drain opening when said anchoring means are fully inserted into said drain opening.

2. The receptacle of claim 1 in which said anchoring means further includes a generally cylindrical stem portion surrounding said second hollow region and a plurality of triangularly shaped, longitudinally extending bosses formed on said stem portion.

3. The receptacle of claim 1 in which said longitudinally extending bosses are compressible, and insertion of said bosses into the drain opening causes interference fit retention of the receptacle within the drain opening.

4. The receptacle of claim 3 in which said body portion, flange and anchoring means comprise a single, integral member.

5. A receptacle positioned between a basin faucet and a drain opening in the base of the basin for temporary retention of one fluid while allowing another fluid to drain from the basin which comprises:

a body member having an open bowl portion and an adjoining, hollow neck portion opening into said bowl portion;

valve means positioned within said neck portion for controlling the flow of fluid from the bowl portion through the neck portion;

a hollow base member having an upper surface which is joined to the neck portion and a lower surface surrounded by a flange;

anchoring means joined to the lower surface of said base, said anchoring means being insertable into said drain opening for securing the receptacle in an upright position while leaving a plurality of clearance channels between the anchoring means and the drain opening; and a hollow spacing plate having a top surface adjacent said flange and a bottom surface with a plurality of radially extending grooves received therein, said plate being slidably received by the anchoring means such that when said anchoring means are fully inserted into the drain opening, said top surface is contiguous to the flange, said bottom surface is contiguous to the basin while surrounding the drain opening, said radially extending grooves establishing a path for fluid flow from the basin to the clearance channels.

6. The receptacle of claim 5 in which said anchoring means comprises a hollow, generally cylindrical stem and several triangularly shaped, longitudinally extending bosses integrally formed thereon.

7. The receptacle of claim 6 in which said longitudinally extending bosses are compressible, such that compression of said bosses by the drain causes a force-fit retention of the receptacle within said drain opening.

8. The receptacle of claim 7 in which said neck portion is flexible such that the bowl portion can be positioned in a plurality of orientations.

9. The receptacle of claim 8 in which said body member, base member, flange and anchoring means comprise a single integrally formed member.

10. The receptacle of claim 9 in which said valve is manually positionable by means of a knob and a shaft, said shaft passing through the neck portion and being attached between the knob and a closure element.

11. The receptacle of claim 10 which further comprises a lid constructed to fit atop and enclose said bowl portion.

12. The receptacle of claim 11 in which said bowl portion includes an annular lip disposed about the upper edge of said bowl portion.

13. The receptacle of claim 12 in which all component pieces are constructed of a resilient material.

14. The receptacle of claim 4 which further comprises a plug member communicating with said passageway to seal said neck section closed.

15. The receptacle of claim 14 which further comprises a lid constructed to fit atop and enclose said bowl portion.

16. The receptacle of claim 15 in which said bowl portion includes an annular lip disposed about the upper edge of said bowl portion.

17. The receptacle of claim 16 in which all component pieces are constructed of a resilient material.

* * * * *